US005282932A

United States Patent [19]

Ayton

[11] Patent Number: 5,282,932

[45] Date of Patent: Feb. 1, 1994

[54] PROCESS FOR PH AND FIRE CONTROL IN PULP BALERS

[75] Inventor: John R. Ayton, Delta, Canada

[73] Assignee: Canadian Liquid Air Ltd./Air Liquide Canada LTEE

[21] Appl. No.: 963,561

[22] Filed: Oct. 19, 1992

[51] Int. Cl.[5] ..... D21H 11/16

[52] U.S. Cl. ..... 162/100; 162/63; 169/5; 169/45; 169/54

[58] Field of Search ..... 162/63, 100; 169/5, 169/9, 43, 45, 54, 11, 71; 222/386.5, 389, 394

[56] References Cited

U.S. PATENT DOCUMENTS

| | | | |
|---|---|---|---|
| 1,261,715 | 4/1918 | Cuddy | 169/5 |
| 1,880,244 | 10/1928 | Dugas | 169/5 |
| 3,627,630 | 12/1971 | Gagnon | 162/100 |
| 3,901,322 | 8/1975 | Winston | 169/74 |
| 4,111,362 | 9/1978 | Carter | 169/74 |
| 4,658,716 | 4/1987 | Boissevain | 169/5 |

FOREIGN PATENT DOCUMENTS 1288906 9/1991 Canada .

*Primary Examiner*—W. Gary Jones
*Assistant Examiner*—Dean T. Nguyen
*Attorney, Agent, or Firm*—Malcolm B. Wittenberg

[57] ABSTRACT

A fluffy pulp previously dried, having a consistency by 90%, is introduced in a baler where it is subjected to a carbon dioxide comprising atmosphere in order to both reduce or eliminate the fire risk in the baler and to decrease the pH of the pulp by chemically reacting with it. Both gaseous and liquid (snow) carbon dioxide can be used. Preferably, carbon dioxide snow is injected at the bottom of the baler to accelerate the pH control of the pulp, just before compressing the pulp in bales, which compression enhances the pH control reaction between the pulp and the carbon dioxide.

10 Claims, 2 Drawing Sheets

PROCESS FOR PH AND FIRE CONTROL IN PULP BALERS

FIELD OF THE INVENTION

The present invention relates to the preparation of pulp in view of manufacturing paper, and more particularly, to the control of the pH of the pulp solution as well as the reduction of the risk of fire which might happen in certain locations where the process is carried out.

BACKGROUND OF THE INVENTION

The preparation of the pulp from cellulose until the manufacture of paper comprises several steps which are summarized, for example, in PCT/US 90/02823 patent application, as follows:

Wood is comprised of two main components—a fibrous carbohydrate, i.e., cellulosic portion, and a non-fibrous component. The polymeric chains forming the fibrous cellulose portion of the wood are aligned with one another and form strong associated bonds with adjacent chains. The non-fibrous portion of the wood comprises a three-dimensional polymeric material formed primarily of phenylpropane units, known as lignin. Part of the lignin is between the cellulosic fibers, bonding them into a solid mass, although a substantial portion of the lignin is also distributed within the fibers themselves.

For use in paper-making processes, wood must first be reduced to pulp. Pulp may be defined as wood fibers capable of being slurried or suspended and then deposited upon a screen to form a sheet, i.e., of paper. The methods employed to accomplish the pulping step usually involve either physical or chemical treatment of the wood, or a combination of these two treatments, to alter the wood's chemical form and to impart desired properties to the resultant product. There are thus two main types of pulping techniques, i.e., mechanical pulping and chemical pulping. In mechanical pulping, the wood is physically separated into individual fibers. In chemical pulping, the wood chips are digested with chemical solutions to solubilize a portion of the lignin and thus permit its removal. The commonly utilized chemical pulping processes are broadly classified as: (1) the soda process, (2) the sulfite process, and (3) the Kraft process, with the latter process being most commonly used.

In mechanical pulping, the wood fibers are separated from each other by mechanical action of grinders or rotating plates. The mechanical action may be accompanied by the application of certain chemicals to reduce the energy required or to bleach the fibers.

During all of these processes and also during bleaching and drying, the pulp moisture content is reduced to levels at which the mixture is combustible. This most commonly occurs in the final process called "Flash Drying". In mills where the production of paper is not integrated, the pulp is dried in the flash drier and bales of pulp are made to be further shipped to paper manufacture plants.

Furthermore, in order for certain bleaching reactions to occur, the pH of the slurry must be controlled to the range exceeding 9. This level is too high for processing into paper in subsequent processes and an acid treatment is required to lower the pH to the range of 7. Pulp stored at high pH levels are subject to darkening which is prevented by processes described in Canadian Patent No. 1,288,906 in which carbon dioxide is the preferred acid. The use of carbon dioxide at processing stages prior to the pulp dryer, in existing mills, is limited by the difficulty in dissolving the gas in the slurry because of high temperatures and short residence times. In new mills, this can be overcome by proper process equipment design.

In the usual process of manufacturing pulp, said pulp is received in the flash dryer as an aqueous solution having a 50–60% consistency and a pH in the range of 7–8 if sulfuric acid is injected in the aqueous solution. However, sulfuric acid is an environmental concern and the acidic effluents of the mill have to be treated and recycled. If no sulfuric acid is used at this stage, the pH of the pulp is about 11.

However at the output of the baler, the pulp which is now about 90% consistency has to meet the customer's pH specification which is usually about 8 or lower. Thus, there exists a need to decrease the pH of the pulp when it comes out of the baler without using o substantially using sulfuric acid upstream in one stage of the process.

In addition to the above problem and with no relationship with it, the baler is a location well identified in the process where a fire can happen, essentially because of the low moisture content and presence of dust. Sources of ignition may be static spark, overheated pulp, or mechanical friction.

As in any such area, it is usually provided for fire protection with systems like the sprinkler shower system using water or a carbon dioxide snow system using cylinders of carbon dioxide which might be sprayed over the pulp as snow to avoid fire propagation.

It is known, e.g. from Canadian Patent 1,288,906, to use carbon dioxide for the preparation of paper pulp comprising a single or multistage bleaching of the pulp comprising at least one single or last peroxide bleaching stage or treatment followed by treatment of the bleached pulp with an aqueous solution of carbon dioxide, i.e. carbonic acid. As carbonic acid does not destroy the bleaching agent residuals, these residuals continue their bleaching action and prevent bacteria proliferation responsible for the pulp darkening.

However, until now, nobody has even thought about or suggested to simultaneously solve the two independent problems disclosed hereabove by using the same means in order to both control the pH of the pulp in or at the output of the baler and to avoid fire ignition or propagation in the said baler, and thus permit the retrofit of the process to existing mills.

SUMMARY OF THE INVENTION

It is an object of the present invention to simultaneously solve the two above problems. According to the invention, carbon dioxide, is injected in the baler chutes in order to modify the pH of the pulp in the baler, while at the same time replacing air in the baler chutes and then generates an atmosphere surrounding the pulp located in the baler area having a reduced oxygen content compared to air (less than 12% volume and preferably less than 10% volume), thus avoiding any fire ignition and/or propagation. According to a preferred embodiment of the invention, carbon dioxide is also injected simultaneously at the bottom of the baler, close to its output, said carbon dioxide being preferably provided from the same source as the one providing carbon dioxide for the baler chutes.

Preferably, the carbon dioxide injected into the baler and/or the baler chutes will be in gaseous form while the carbon dioxide injected at the bottom and/or the output of the baler will be in liquid form (i.e., injected at atmospheric pressure as carbon dioxide snow).

The flow rate of each of the gas and/or liquid flows will be adjusted first to ensure a substantially oxygen-free atmosphere in the baler.

It is usually required that the residence time of the fluffed dry pulp in the baler be greater than at least about two and preferably three minutes in order to have a sufficient contact between the pulp and the carbon dioxide to promote the chemical reaction necessary to decrease the pH of the pulp. Any means which will increase the physical contact of the pulp with carbon dioxide can be used, such as multi-injection ducts or nozzles, preferably spraying carbon dioxide gas (or liquid or snow) throughout the cross-section of the baler. Those ducts or nozzles can be oriented downwardly to avoid plugging at their tip but they might be also oriented upwardly if the pressure of the gas (or liquid or snow) is sufficient to prevent plugging. This last solution increase the efficiency and the duration of the contact between the pulp and carbon dioxide. It will also be preferred to have several injection devices at different levels in the baler, starting from the top to the bottom, preferably regularly spaced, with flow rates, e.g. preferably higher at the top than the bottom. Carbon dioxide concentration is preferably measured throughout the chutes of the baler and pressure is controlled as well.

At the bottom of the baler and preferably just before the fluffed pulp is pressed, it is usually preferred to have an additional carbon dioxide injection, preferably as snow. As the pressing of the pulp under carbon dioxide atmosphere has shown a beneficial effect on the achievement of pH decrease in the pulp, carbon dioxide liquid injection (which is in fact carbon dioxide snow at about atmospheric pressure) not only cools the pulp down, but increases carbon dioxide contact with the pulp, allowing usually to achieve the goal of a pH of the pulp between 7.5 and 8. Whether gas or liquid carbon dioxide is used, the pressing step substantially increases the efficacy of the process in terms of pH decrease. Furthermore, the use of the process according to the invention usually eliminated the need for scavenging dust from the chutes of the baler to reduce the fire risks. Another advantage of the invention is also to substantially eliminate all the sulphur species still present in the pulp.

The invention more particularly applies to Thermal Mechanical Pulp, including Chemical Thermal Mechanical Pulp and also Kraft pulp, while not necessarily limited to those pulps. The pH of the pulp so treated is usually greater than 7 (before treatment), and usually greater than 8.

DETAILED DESCRIPTION OF THE INVENTION

The process according to the invention is illustrated in FIGS. 1 and 2, wherein.

Figure 1:
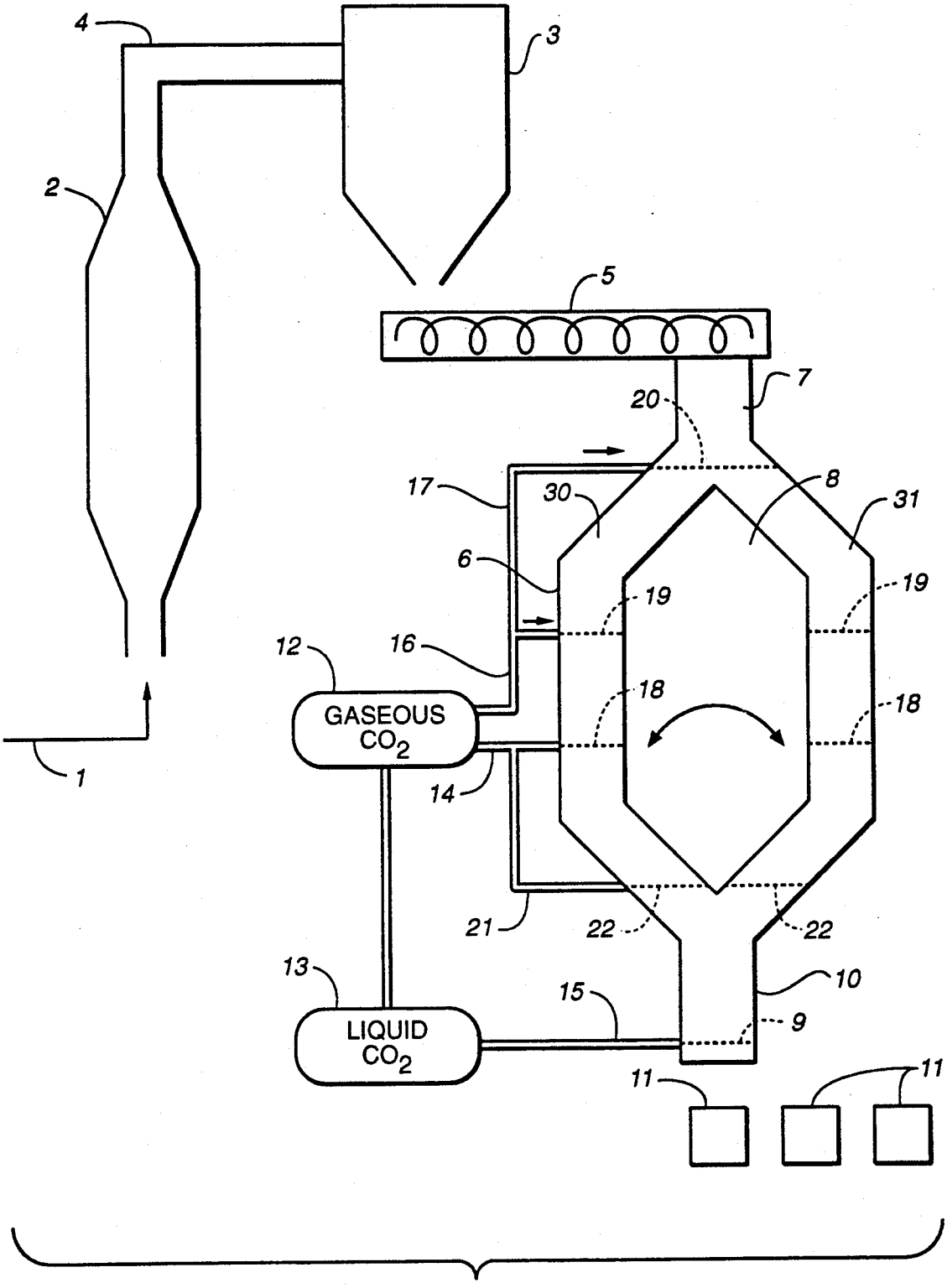
FIG. 1 is a schematic view of the processing of pulp using carbon dioxide injection according to the invention.

On FIG. 1, the pulp 1 having a consistency of about 50–60% in aqueous solution is blown into the flash dryer 2 where it is dried and then sucked into the duct 4 and discharged into the cyclone 3, wherein the pulp has a consistency of about 90%. The cyclone 3 has an opening at the bottom through which the pulp falls onto a conveyor 5 which conveys it at the top input of the baler 6. This baler 6 comprises several ducts like 30 and 31 having a rectangular cross-section, connected to the input duct 7 at the top of the baler 6 and the output duct 10 at the bottom of the baler 6. At the bottom end of the duct 10 is provided a press (not shown on the figure) which presses the pulp in bales 11 which are conveyed to the next process step (usually in a different plant or location).

The carbon dioxide is injected in the baler, preferably through the chutes of the baler in such a way that a contact between the pulp and the carbon dioxide occurs as soon as possible when the pulp enters the top conduit 7 of the baler 6. This usually means that substantially at least a portion (bottom portion) and preferably all the ducts of the baler comprise an atmosphere which comprises at least 88% volume and preferably at least 90% volume of carbon dioxide, with the complement being residual air. After starting to run the plant, residual oxygen concentration should be maintained preferably lower than 10% volume in the baler which is effective for both fire protection and pH control of the pulp. As carbon dioxide is heavier than air, the complete inerting of the baler with carbon dioxide requires that injection is made above the level where inerting should occur. On FIG. 1, for this purpose, a carbon dioxide gas (or liquid) injection device 20 connected to the gaseous reservoir $GCO_2$ 12 is provided at the top of the baler 6 (it can be located anywhere in the duct 7 but before separation in different chutes like 30 and 31). Usually a multi-injection system (e.g. as exemplified on FIG. 2) is used for that purpose. Similar gas (or liquid) injectors are provided at different levels of the chutes of the baler, such as gas injectors 18, 19 and 22, which are respectively connected to the carbon dioxide reservoir 12 through ducts 16, 14 and 21.

At the bottom of the baler (in the bottom duct 1) is provided, usually just above the press, a carbon dioxide injection system 9 to inject carbon dioxide in the pulp (preferably snow, but gas, particularly cold gas might be adequate in certain circumstances where the pH of the pulp is already quite close to the specification). The bales 11 are then subjected to carbon dioxide which continues to react with the pulp to decrease its pH.

Figure 2:
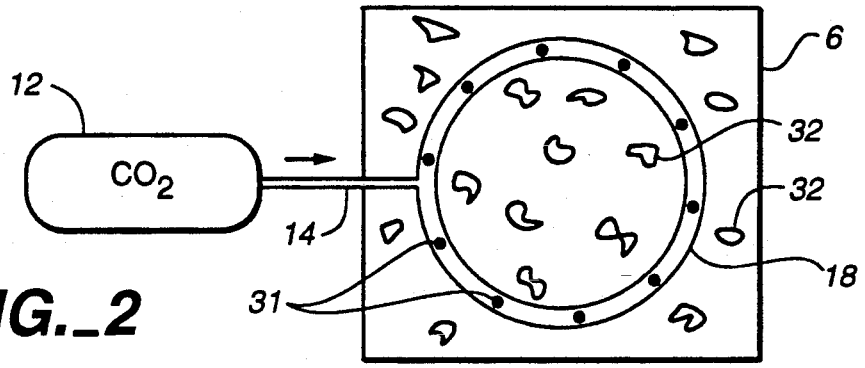
FIG. 2 is a cross-section of the chute of the baler with a carbon dioxide injection device.

FIG. 2 is a rough illustration of an injection system (gas or snow) of carbon dioxide located, for example, in the duct 30 of the baler 6. It comprises a cylindrical duct 14 which feeds a duct 18 having a ring shape and a substantially circular cross-section. The ring shaped duct 18 is provided with holes (or nozzles) 31 at regular distance from one another. 32 represents pieces of pulp. The orientation of the holes might be such that $CO_2$ jets are oriented downward and/or upward and/or in the horizontal plane defined by the ring and/or any direction in such a way that a carbon dioxide atmosphere be generated throughout the ducts of the baler (diameter and/or orientation of the holes can be different whether the hole is in front of an angle of the duct or in front of a flat wall of said duct).

The injection system can also be more simple and comprise only a duct with a dead-end and holes or nozzles to escape carbon dioxide. The holes at the bottom will spray liquid or snow if liquid $CO_2$ is used, while usually the hole or nozzle at the top and usually oriented upward, will spray gas.

Examples have been carried out in simulated baler conditions at laboratory scale.

Pulp from a CTMP (Chemical Thermal Mechanical Pulp) mill was treated in a laboratory to simulate the latter stages of pulp processing prior to and including pulp drying. The pulp sample was obtained before treatment with acid to lower the pH and it was then diluted to 10% consistency followed by pressing to 55% consistency. This simulated the conditions prior to the pulp dryer. The sample was then pin-shredded and dried in an oven to 90% consistency.

The sample was then subjected to a high concentration of carbon dioxide in a sealed container for periods of 2, 3 and 4 minutes, after which each sample was tested for pH.

From an initial pH of the pulp of 8.8, the results obtained were 7.75, 7.5 and 7.49, respectively. These times were representative of typical baler/press conditions.

The oxygen concentration measured in the sealed container was lower than 5% volume, i.e., well below the minimum oxygen concentration which would permit combustion.

Additional tests have shown that carbon dioxide injection in the pulp (having a pH of 8.8) to simulate carbon dioxide injection at the top of the baler (or even upstream in the process disclosed herein) allowed to decrease the pulp pH. Thus, a multiple point injection of carbon dioxide in the pulp allows to reach pH at least as low as 7.5

I claim:

1. A process for pH and fire control in pulp balers comprising the steps of providing a fluffed pulp having a consistency greater than 90% and a pH greater than 7, dropping said pulp by gravity in at least one duct of a baler, simultaneously injecting carbon dioxide in at least a portion of said duct in order to at least partially replace the atmosphere in said duct by an atmosphere comprising at least 88% volume of carbon dioxide, providing a physical contact between the pulp and the carbon dioxide comprising atmosphere during a period of time which is at least equal to or greater than substantially two minutes in order to generate a chemical reaction in the pulp to decrease the pH of said pulp, stacking the pulp by gravity at the bottom of the baler and then compressing the pulp in bales.

2. A process according to claim 1, wherein the carbon dioxide is injected at least at the top of the at least one duct of the baler.

3. A process according to claim or 2, wherein carbon dioxide is injected in gaseous form.

4. A process according to claim 1 or 2 wherein carbon dioxide is injected as carbon dioxide snow.

5. A process according to claim or 2 wherein carbon dioxide is injected as a mixture of gas and snow.

6. A process according to claim 1, further comprising the step of injecting carbon dioxide snow at the bottom of the baler where pulp is stacked, before or during compression in bales.

7. A process according to claim 1, wherein the pH of the pulp in the bales is lower than 8.

8. A process according to claim 7, wherein the pH of the pulp in the bales is lower than 7.5.

9. A process according to claim 1, wherein the physical contact between the pulp and the carbon dioxide comprising atmosphere is at least three minutes.

10. A process according to claim 1, wherein the carbon dioxide comprising atmosphere comprises at least 90% volume of carbon dioxide.

* * * * *